US008927847B2

(12) United States Patent
Chafe

(10) Patent No.: US 8,927,847 B2
(45) Date of Patent: Jan. 6, 2015

(54) GLITCH-FREE FREQUENCY MODULATION SYNTHESIS OF SOUNDS

(71) Applicant: The Board of Trustees of the Leland Stanford Junior University, Palo Alto, CA (US)

(72) Inventor: Christopher D. Chafe, Palo Alto, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 0 days.

(21) Appl. No.: 14/301,270

(22) Filed: Jun. 10, 2014

(65) Prior Publication Data

US 2014/0360342 A1 Dec. 11, 2014

Related U.S. Application Data

(60) Provisional application No. 61/833,887, filed on Jun. 11, 2013.

(51) Int. Cl.
*G10H 1/04* (2006.01)
*G10H 1/06* (2006.01)

(52) U.S. Cl.
USPC ..... 84/671; 84/691; 84/718; 332/117

(58) Field of Classification Search
USPC ..... 84/671
See application file for complete search history.

(56) References Cited

U.S. PATENT DOCUMENTS 4,386,547 A * 6/1983 Chibana ..... 84/625
4,406,204 A * 9/1983 Katoh ..... 84/119
4,422,362 A * 12/1983 Chibana ..... 84/624
4,581,749 A * 4/1986 Carney et al. ..... 375/302
5,191,161 A * 3/1993 Oya ..... 84/604
5,206,446 A * 4/1993 Matsumoto et al. ..... 84/624
5,218,156 A * 6/1993 Iizuka et al. ..... 84/624
5,340,938 A * 8/1994 Sugita et al. ..... 84/605
5,524,173 A * 6/1996 Puckette ..... 704/268
5,604,323 A * 2/1997 Hardie-Bick ..... 84/604
5,610,354 A * 3/1997 Masahiro et al. ..... 84/624

(Continued)

OTHER PUBLICATIONS

Chafe, Glitch Free FM Vocal Synthesis, Center for Computer Research in Music and Acoustics, Stanford University, Jul. 27, 2013, 7 pgs.

(Continued)

*Primary Examiner* — David S. Warren
(74) *Attorney, Agent, or Firm* — Morgan, Lewis & Bockius LLP

(57) ABSTRACT

A time-varying formant is generated at a formant frequency by generating first and second harmonic phase signals having first and second harmonic numbers, respectively, in relation to a modulation frequency. The first and second harmonic phase signals are generated in proportion to a master phase signal, which varies at the modulation frequency, modulo a factor corresponding to their harmonic numbers. First and second sound signals, based on the first and second harmonic phase signals, are frequency modulated to create an arbitrarily rich harmonic spectrum, depending on an FM index. The time-varying formant is generated by generating a time-varying combination of the first and second harmonic sound signals, weighting the first and second harmonic sound signals in accordance with their spectral proximities to the formant frequency. One or more of the harmonic numbers are updated when the time-varying formant frequency passes the frequency of either sound signal.

28 Claims, 11 Drawing Sheets

(56) References Cited

U.S. PATENT DOCUMENTS

| | | | | |
|---|---|---|---|---|
| 5,719,345 | A * | 2/1998 | Chen | 84/624 |
| 5,900,570 | A * | 5/1999 | Rossum | 84/653 |
| 6,195,632 | B1 * | 2/2001 | Pearson | 704/206 |
| 6,410,838 | B1 * | 6/2002 | Takeuchi | 84/607 |
| 6,756,532 | B2 * | 6/2004 | Wachi et al. | 84/604 |
| 7,127,020 | B2 * | 10/2006 | Brown | 375/371 |
| 7,529,660 | B2 * | 5/2009 | Bessette et al. | 704/205 |
| 8,612,216 | B2 * | 12/2013 | Gartner et al. | 704/208 |
| 8,731,695 | B2 * | 5/2014 | Sapp | 700/94 |
| 2001/0049994 | A1 * | 12/2001 | Wachi et al. | 84/604 |
| 2003/0112893 | A1 * | 6/2003 | Lee et al. | 375/302 |
| 2005/0165603 | A1 * | 7/2005 | Bessette et al. | 704/200.1 |
| 2007/0157796 | A1 * | 7/2007 | Akazawa et al. | 84/604 |
| 2007/0256542 | A1 * | 11/2007 | Tamura et al. | 84/604 |
| 2008/0055014 | A1 * | 3/2008 | Tsfaty | 332/127 |
| 2009/0024399 | A1 * | 1/2009 | Gartner et al. | 704/500 |
| 2009/0158919 | A1 * | 6/2009 | Akazawa | 84/622 |
| 2012/0226370 | A1 * | 9/2012 | Sapp | 700/94 |
| 2013/0231932 | A1 * | 9/2013 | Zakarauskas et al. | 704/236 |
| 2014/0108020 | A1 * | 4/2014 | Sharma et al. | 704/500 |
| 2014/0142958 | A1 * | 5/2014 | Sharma et al. | 704/500 |

OTHER PUBLICATIONS

Lazzarini, Theory and Practice of Modified Frequency Modulation Synthesis, J. Audio Eng. Soc., vol. 58, No. 6, Jun. 2010, pp. 459-471.

* cited by examiner

300

```
w = f / SR;                                   302
mp  = 0.0;                                    304
for i = 1 to N;                               306
        ms[i] = a * sin(2*pi*mp);             308
        mp = (mp + w) mod 1.0;                310
        m[o] = ms[i]*i[o];                    312
        cp[o][i] = mp mod (1/h[o]) + m[o];    314
        y[o][i] = g[o]*sin(2*pi*h[o]*cp[o][i])  316
end
```

FIG. 3

GLITCH-FREE FREQUENCY MODULATION SYNTHESIS OF SOUNDS

RELATED APPLICATIONS

This application claims priority to U.S. Provisional Patent Application No. 61/833,887, filed Jun. 11, 2013, which is hereby incorporated by reference in its entirety.

TECHNICAL FIELD

The disclosed implementations relate generally to a method and apparatus for synthesizing sounds using frequency modulation synthesis. The disclosed implementations relate specifically to a method and apparatus for synthesizing glitch-free vocal sounds using frequency modulation synthesis.

BACKGROUND

Frequency Modulation (FM) synthesis is a technique for generating complex sound spectra such as synthesized musical instrument and vocal sounds. Such synthesized sounds are typically comprised of formants which, in some conventional FM techniques, are approximated as harmonics of a modulation frequency. In circumstances in which the formant frequency and modulation frequency are static (i.e., do not change over time), the harmonics of the modulation frequency are also static. However, FM synthesis of the human voice, with its wide prosodic and expressive variations in pitch and timbre, requires changes in either the underlying modulation frequency, or one or more of formant frequencies, or both.

FIG. 1A illustrates a fast Fourier transform (FFT) based spectrograph 100 with a sampling window having a width of 4096 samples and a 48 kHz sampling rate. The spectrograph is a representation of sound produced using a conventional FM synthesis technique (e.g., one in which each formant is approximated by a single harmonic oscillator) to synthesize a sequence of phonemes in a human-voice timbre. Specifically, the sequence of phonemes in this example is a vowel alteration of the sounds "ee-oo-ee-oo." In this example, the vowel alteration creates excursions in the underlying modulation frequency and/or formant frequencies that manifest as artifacts 102 in spectrograph 100. These artifacts are perceived by the listener as audible clicking sounds.

FIG. 1B similarly illustrates a fast Fourier transform (FFT) based spectrograph 104 with a sampling window having a width of 4096 samples and a 48 kHz sampling rate. Here, however, the spectrograph represents a synthesis of a human voice undergoing vibrato, in which one or more formant frequencies in the generated sound vary periodically with time. For example, formant 106, as shown in FIG. 1B, varies at approximately 3 Hz with an amplitude 108. For small vibrato amplitude, no artifacts are introduced. However, for large vibrato amplitude, artifacts 110 are introduced. The artifacts 110 are an example of what are referred to herein as "type-1" artifacts, which is understood to mean artifacts originating from changes to (or shifts in) the frequency of the signal generated by a harmonic oscillator. Similar problems occur in conventional methods when attempting to synthesize portamento and glissando sound effects.

Accordingly, there is a need for FM synthesis techniques that produce artifact-free (sometimes herein called "glitch-free") sound when the modulation frequency and/or one or more formant frequencies varies over time.

SUMMARY

One aspect of the present disclosure provides a method of synthesizing sound. The method includes generating a master phase signal that varies in time at a modulation frequency, and optionally generating a modulation signal in accordance with the master signal and a modulation index. The method further includes generating one or more time-varying formants, each at a respective time-varying formant frequency. Generating each time-varying formant includes generating a first harmonic phase signal having a first harmonic number in relation to the modulation frequency, wherein the first harmonic phase signal is generated in proportion to the master phase signal modulo a factor corresponding to the first harmonic number; and generating a first harmonic sound signal based on the first harmonic phase signal, wherein the first harmonic sound signal has a spectral peak centered substantially at a frequency of the first harmonic phase signal (e.g., when the first harmonic sound signal is frequency modulated by the modulation signal). Generating the time-varying formant further includes generating a second harmonic phase signal having a second harmonic number in relation to the modulation frequency, wherein the second harmonic phase signal is generated in proportion to the master phase signal modulo a factor corresponding to the second harmonic number; and generating a second harmonic sound signal based on the second harmonic phase signal, wherein the second harmonic sound signal has a spectral peak substantially at a frequency of the second harmonic phase signal (e.g., when the second harmonic sound signal is frequency modulated by the modulation signal). Generating the time-varying formant further includes generating the time-varying formant at the time-varying formant frequency by generating a time-varying combination of the first harmonic sound signal and the second harmonic sound signal, wherein the combination weights the first harmonic sound signal in accordance with a spectral proximity of the frequency the first harmonic phase signal to the formant frequency, and weights the second harmonic sound signal in accordance with a spectral proximity of the frequency of the second harmonic phase signal to the formant frequency.

In some implementations, the factor corresponding to first harmonic number is an inverse of the first harmonic number, and the factor corresponding to second harmonic number is an inverse of the second harmonic number.

In some implementations, generating the first harmonic sound signal based on the first harmonic phase signal includes modulating the first harmonic phase signal at the modulation frequency, and generating the second harmonic sound signal based on the second harmonic phase signal includes modulating the second harmonic phase signal at the modulation frequency.

In some implementations, the first harmonic number is a floor function integer approximation of a ratio of the formant frequency to the modulation frequency, and the second harmonic number is a ceiling function integer approximation of the ratio of the formant frequency to the modulation frequency.

In some implementations, the method further includes generating a phoneme comprising two or more of said time-varying formants, each having a respective time-varying formant frequency.

In some implementations, the method further includes generating a sequence of phonemes by changing at least one of the respective time-varying formant frequency over time in accordance with the sequence of phonemes.

In some implementations, the method further includes varying the modulation frequency over time in accordance with the sequence of phonemes.

In some implementations, one of the first harmonic number and second harmonic number is odd and the other of the first harmonic number and second harmonic number is even. In some implementations, the first harmonic number and the second harmonic number differ by 1.

In some implementations, the combination is a linear combination of the first harmonic sound signal and the second harmonic sound signal.

In some implementations, the method further includes varying the linear combination over time in accordance with a nonlinear function of the spectral proximity of the frequency of the first harmonic phase signal to the formant frequency.

Another aspect of the present disclosure provides a non-transitory computer readable storage medium. The non-transitory computer readable storage medium stores one or more programs configured for execution by one or more processors of a computer-based sound synthesizer. The one or more programs include instructions to generate a master phase signal that varies in time at a modulation frequency, and generate one or more time-varying formants, each at a respective time-varying formant frequency. Generating each time-varying formant includes generating a first harmonic phase signal having a first harmonic number in relation to the modulation frequency, wherein the first harmonic phase signal is generated in proportion to the master phase signal modulo a factor corresponding to the first harmonic number; and generating a first harmonic sound signal based on the first harmonic phase signal, wherein the first harmonic sound signal has a spectral peak centered substantially at a frequency of the first harmonic phase signal. Generating the time-varying formant further includes generating a second harmonic phase signal having a second harmonic number in relation to the modulation frequency, wherein the second harmonic phase signal is generated in proportion to the master phase signal modulo a factor corresponding to the second harmonic number; and generating a second harmonic sound signal based on the second harmonic phase signal, wherein the second harmonic sound signal has a spectral peak substantially at a frequency of the second harmonic phase signal. Generating the time-varying formant further includes generating the time-varying formant at the time-varying formant frequency by generating a time-varying combination of the first harmonic sound signal and the second harmonic sound signal, wherein the combination weights the first harmonic sound signal in accordance with a spectral proximity of the frequency the first harmonic phase signal to the formant frequency, and weights the second harmonic sound signal in accordance with a spectral proximity of the frequency of the second harmonic phase signal to the formant frequency.

Another aspect of the present disclosure provides a computer based sound synthesizer system. The sound synthesizer system includes one or more processors and memory storing one or more programs that, when executed by the one or more processors, cause the synthesizer system to generate a master phase signal that varies in time at a modulation frequency, and generate one or more time-varying formants, each at a respective time-varying formant frequency. Generating each time-varying formant comprises generating a first harmonic phase signal having a first harmonic number in relation to the modulation frequency, wherein the first harmonic phase signal is generated in proportion to the master phase signal modulo a factor corresponding to the first harmonic number; and generating a first harmonic sound signal based on the first harmonic phase signal, wherein the first harmonic sound signal has a spectral peak centered substantially at a frequency of the first harmonic phase signal. Generating the time-varying formant further includes generating a second harmonic phase signal having a second harmonic number in relation to the modulation frequency, wherein the second harmonic phase signal is generated in proportion to the master phase signal modulo a factor corresponding to the second harmonic number; and generating a second harmonic sound signal based on the second harmonic phase signal, wherein the second harmonic sound signal has a spectral peak substantially at a frequency of the second harmonic phase signal. Generating the time-varying formant further includes generating the time-varying formant at the time-varying formant frequency by generating a time-varying combination of the first harmonic sound signal and the second harmonic sound signal, wherein the combination weights the first harmonic sound signal in accordance with a spectral proximity of the frequency the first harmonic phase signal to the formant frequency, and weights the second harmonic sound signal in accordance with a spectral proximity of the frequency of the second harmonic phase signal to the formant frequency.

BRIEF DESCRIPTION OF THE DRAWINGS

FIG. 3 is an example pseudo-code used to generate two or more phase-synchronized oscillators which are combined to synthesize a formant, in accordance with some implementations.

Like reference numerals refer to corresponding parts throughout the drawings.

DESCRIPTION OF IMPLEMENTATIONS

Figure 1A:
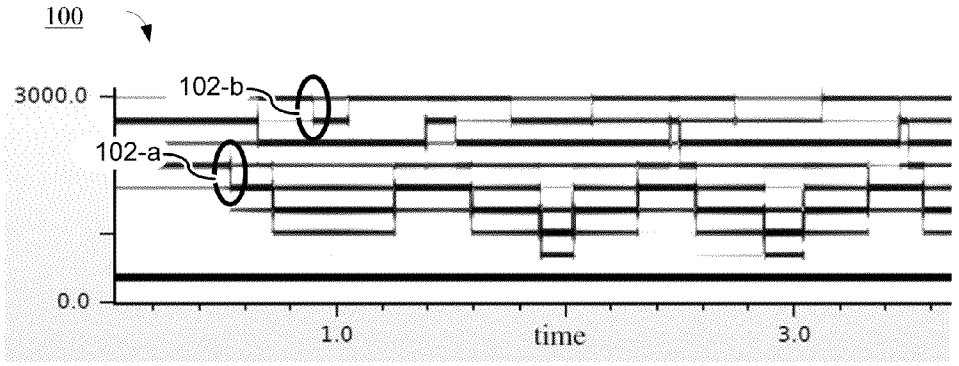
FIG. 1A illustrates a fast Fourier transform (FFT) based spectrograph of a synthesized vowel alteration.

It will be understood that, although the terms "first," "second," etc. are sometimes used herein to describe various elements, these elements should not be limited by these terms. These terms are only used to distinguish one element from another. For example, a first element could be termed a second element, and, similarly, a second element could be termed a first element, without changing the meaning of the description, so long as all occurrences of the "first element"

are renamed consistently and all occurrences of the second element are renamed consistently. The first element and the second element are both elements, but they are not the same element.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, operations, operations, elements, and/or components, but do not preclude the presence or addition of one or more other features, integers, operations, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined (that a stated condition precedent is true)" or "if (a stated condition precedent is true)" or "when (a stated condition precedent is true)" may be construed to mean "upon determining" or "in response to determining" or "in accordance with a determination" or "upon detecting" or "in response to detecting" that the stated condition precedent is true, depending on the context.

As used herein, the term "center frequency" refers to a target frequency of a formant being synthesized (also sometimes simply referred to as a formant frequency). The term "carrier frequency" refers to the frequency of an oscillator used to synthesize a formant. The term "modulation frequency" refers to the fundamental frequency upon which harmonic frequencies are based. For example, an oscillator with a harmonic number of 4 will have a carrier frequency of 4 times the modulation frequency. In some implementations, as described below, two oscillators are used to synthesize a formant. For example, consider a formant having center frequency, at an instant in time, with a non-integer harmonic number of 4.7. In other words, the center frequency equals 4.7 times the modulation frequency. As discussed in more detail below, two oscillators are used to synthesize such a formant, one of the oscillators having a harmonic number of 4 and the other of the oscillators having a harmonic number of 5.

Reference will now be made in detail to various implementations, examples of which are illustrated in the accompanying drawings. In the following detailed description, numerous specific details are set forth in order to provide a thorough understanding of the present disclosure and the described implementations herein. However, implementations described herein may be practiced without these specific details. In other instances, well-known methods, procedures, components, and mechanical apparatus have not been described in detail so as not to unnecessarily obscure aspects of the implementations.

Figure 2A:
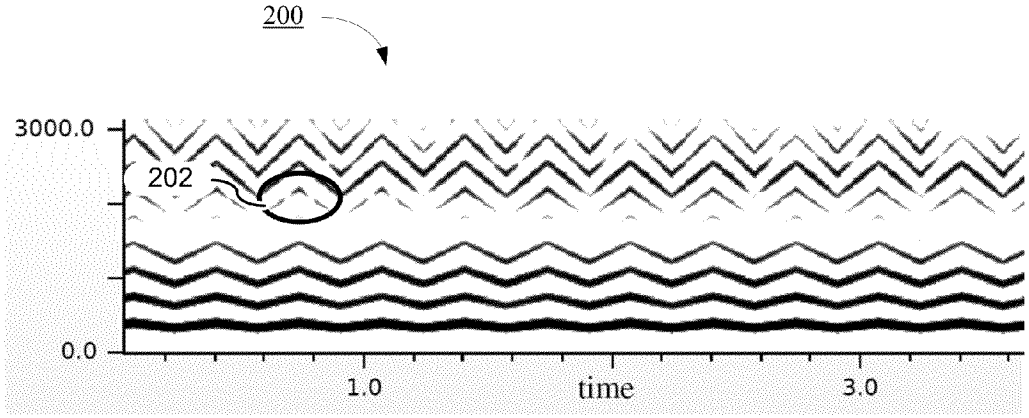
FIG. 2A illustrates a fast Fourier transform (FFT) based spectrograph of a vibrato sound generated without type-1 artifacts, in accordance with some implementations.

FIG. 2A illustrates a fast Fourier transform (FFT) based spectrograph 200 with a sampling window having a width of 4096 samples and a 48 kHz sampling rate. The spectrograph 200 is a representation of human-voice vibrato sound produced using a modified FM synthesis technique, in accordance with some implementations. In this example, two oscillators corresponding to even and odd harmonic numbers are assigned to each formant, "bracketing" the true formant center frequency, $f_c$. Their harmonic number assignments are, respectively, made from the two nearest harmonics, as follows:

$$h_{lower}=\lfloor f_c/f_m \rfloor$$

$$h_{upper}=\lfloor f_c/f_m \rfloor$$

where $f_c$ is the formant center frequency, $f_m$ is the modulation frequency, the function $\lfloor x \rfloor$ is the "round down" function, producing an output equal to the integer value closest to, but no greater than, the argument (also called the input value) of the round down function (e.g., $\lfloor 4.7 \rfloor$ is equal to 4); and the function $\lceil x \rceil$ is the "round up" function, producing an output equal to the integer value closest to, but no less than, the argument (also called the input value) of the round up function (e.g., $\lceil 4.7 \rceil$ is equal to 5). Each oscillator of the pair of oscillators then oscillates (e.g., produces a signal, typically having an frequency in the audio domain) at a carrier frequency (sometimes herein called an oscillator frequency) equal to its respective harmonic number h times the modulation frequency $f_m$. Stated mathematically, the oscillator frequencies of the pair of oscillators are: $\lfloor f_c/f_m \rfloor * f_m$ and $\lfloor f_c/f_m \rfloor * f_m$.

Figure 1B:
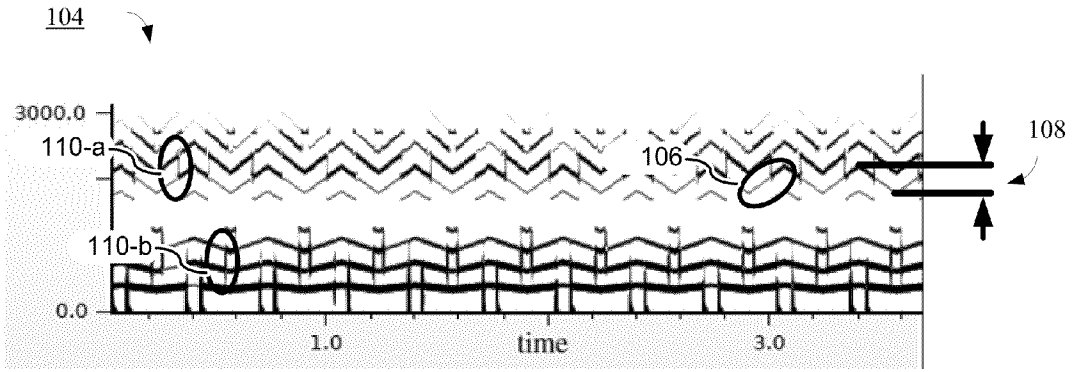
FIG. 1B illustrates a fast Fourier transform (FFT) based spectrograph of a vibrato sound.

In some implementations, assignment of harmonic numbers to individual oscillators is dynamic, changing as the center frequency $f_c$ of the formant changes, and depends on whether they are even numbered or odd numbered. When an oscillator, of the pair of oscillators being used to generate a time-varying formant having a time-varying center frequency $f_c$, is required to change its harmonic number because the formant center frequency $f_c$ has shifted, the center frequency of the formant is equal to or approaching the frequency of the other oscillator of the oscillator pair (i.e., equal to or approaching the harmonic number of the other oscillator multiplied by $f_m$). In some implementations, the two respective oscillators are "cross-faded," meaning that the gains of the two oscillators sum to a constant (e.g., unity) in a mixture in which each oscillator has a corresponding gain. In some implementations, the oscillator gains are complementary and determined by proximity to the formant frequency. In some implementations, the oscillator gains are linearly determined by proximity to the formant frequency. Thus, the oscillator which is undergoing a frequency change is substantially muted. For example, during the generation of a formant having a center frequency $f_c$ that transitions from 4.7 to 5.3 times the modulation frequency, the two oscillators used to generate the formant are initially assigned harmonic numbers of 4 and 5, respectively. When the center frequency of the formant either reaches 5 times the modulation frequency or first exceeds 5 times the modulation frequency, the oscillator having a harmonic number of 4 is assigned a new harmonic number of 6, and furthermore has a gain equal to zero or very close to zero. As a result, the type-1 artifacts 110 as seen in FIG. 1B are absent from the spectrograph 200. Assigning two oscillators to each formant in the manner described above also sharpens the accuracy with which the formant frequency is being synthesized.

Despite the removal of the type-1 artifacts, a problem arises in some circumstances due to a phase mismatch between the two oscillators (e.g., the odd and the even oscillators) which are mixed (e.g., combined) to produce the formant. The phase mismatch manifests as a "fringing" artifact 202 seen in the spectrograph 200. Fringing artifacts are herein after referred to as "type-2" artifacts, which are understood to arise from a phase mismatch between two or more oscillators used to generate a respective formant.

In some circumstances, type-2 artifacts are most notable when the cross-fade mixture of the two oscillators approaches equal proportions (e.g., the two oscillators synthesize a formant having a center frequency half way between the two oscillator carrier frequencies). Conversely, in such circumstances, the type-2 artifacts are least notable when one of the two oscillator's carrier frequencies is close to the center frequency and the other is substantially muted. Accordingly, in some implementations, the oscillator gains are complementary and determined nonlinearly by proximity of the respective oscillator carrier frequencies to the formant's center frequency, $f_c$. For example, a first oscillator of the two oscillators has a corresponding gain given by a power law function of the spectral proximity of the frequency of the first harmonic phase signal to the formant frequency, such as $g_1=$ $$\left|\left(\frac{f_c}{f_m}\right)-h_2\right|^n,$$

where $g_1$ is the gain of the first oscillator, $h_2$ is the harmonic number of the second oscillator, $f_c$ is the formant center frequency, $f_m$ is the modulation frequency, and n is a "cross-fade" ramp that is a number greater than or equal to 1; or equivalently $g_1=|(f_c-f_{h2})/f_m|^n$, where $f_{h2}$ is the frequency of the second oscillator. For example, in some implementations, n is a number greater than or equal to 1 and less than or equal to 7. The second oscillator of the two oscillators has a corresponding gain given by $g_2=\sqrt{1-g_1^2}$. In accordance with some implementations, providing a non-linear cross-fade ramp (i.e., a cross-fade ramp that is greater than 1) minimizes an amount of time where phase interface of the two oscillators is most pronounced.

Figure 2B:
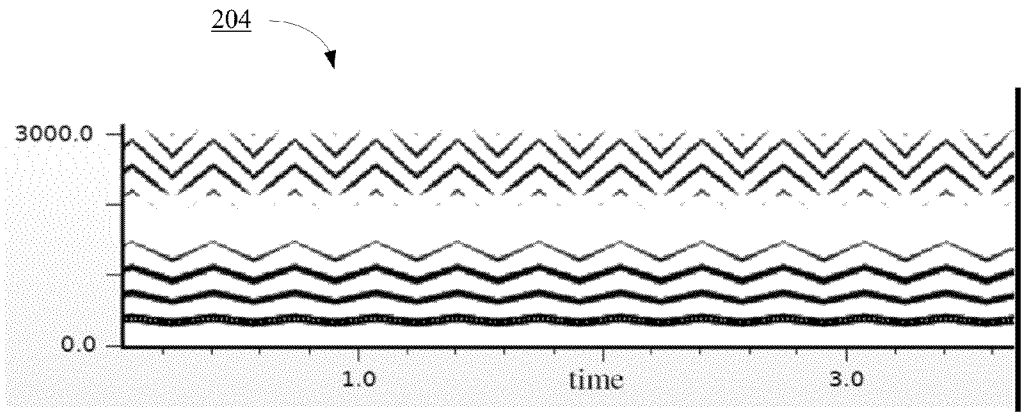
FIG. 2B illustrates a fast Fourier transform (FFT) based spectrograph of a vibrato sound generated without type-1 or type-2 artifacts, in accordance with some implementations.

FIG. 2B illustrates a fast Fourier transform (FFT) based spectrograph 204 with a sampling window having a width of 4096 samples and a 48 kHz sampling rate. The spectrograph 204 is a representation of human-voice vibrato sound produced using a modified FM synthesis technique, in accordance with some implementations. In an analogous manner to the sound represented by spectrograph 200 in FIG. 2A, two oscillators corresponding to even and odd harmonic numbers are assigned to each formant, "bracketing" the true formant center frequency. Their assignments are also made in analogous fashion to the two oscillators described with reference to FIG. 2A. However, the two oscillators used to produce the sound represented by spectrograph 204 are phase-synchronized with respect to one another. Specifically, the phase of each oscillator is generated based on a single common phasor, as described with reference to pseudo-code 300 (FIG. 3) as well as method 600 (described with reference to FIG. 6A-6C). The use of phase-synchronized oscillators substantially eliminates type-2 artifacts, as shown in spectrograph 204.

FIG. 3 is an example pseudo-code 300 of a computer-implemented method to generate two or more phase-synchronized oscillators which are combined to synthesize a formant, in accordance with some implementations. A phase-increment "w" is set (302) in accordance with a fundamental pitch "f" and a sampling rate "SR." A master phase is initialized (304) to a constant, which, for simplicity, is "0.0" in this example. For each sample (306), from a first sample to a sample "N", the operations 308 through 316 are performed. A master signal ms is set (308) in accordance with the master phase. The master phase "ms" is updated (310) in accordance with the phase-increment "w" modulo unity. A modulation signal "m[o]" is set (312) in accordance with the master signal "ms" and a modulation index "i[o]", where o is a harmonic number corresponding to a particular oscillator. Operation 312 therefore determines an individual modulation strength for each oscillator. The modulation indices determine the formant bandwidth. An oscillator phase "cp[o][i]" is set (314) for each oscillator and for the sample "i". Finally, a harmonic sound signal "y[o][i]" is set (316) for each oscillator for the sample "i." As can be seen from the equations in FIG. 3, each of the harmonic sound signals y[o][i] is frequency modulated by the modulation signal m[o]. As a result, the harmonic sound signals y[o] [i] have arbitrarily rich harmonic spectrums, depending on the FM index used for the frequency modulation.

In some implementations, operations 312, 314 and 316 are repeated for each oscillator, o, before the loop repeats for a next value of i. For example, if signals y[1][i] and y[2] [i] are being generated for two oscillators that together are used to generate a formant, operations 312, 314 and 316 are repeated for each of the two oscillators. Furthermore, in some embodiments, the loop includes instructions for setting or updating the gain, g[o], for each oscillator. For example, the gains of the oscillators can be updated using any of the methodologies described elsewhere in this document. In some embodiments, the loop includes instructions for setting or updating the gain, g[o], and harmonic number, h[o], for each oscillator. For example, the gains and harmonic numbers of the oscillators can be updated using any of the methodologies described elsewhere in this document.

Figure 4A:
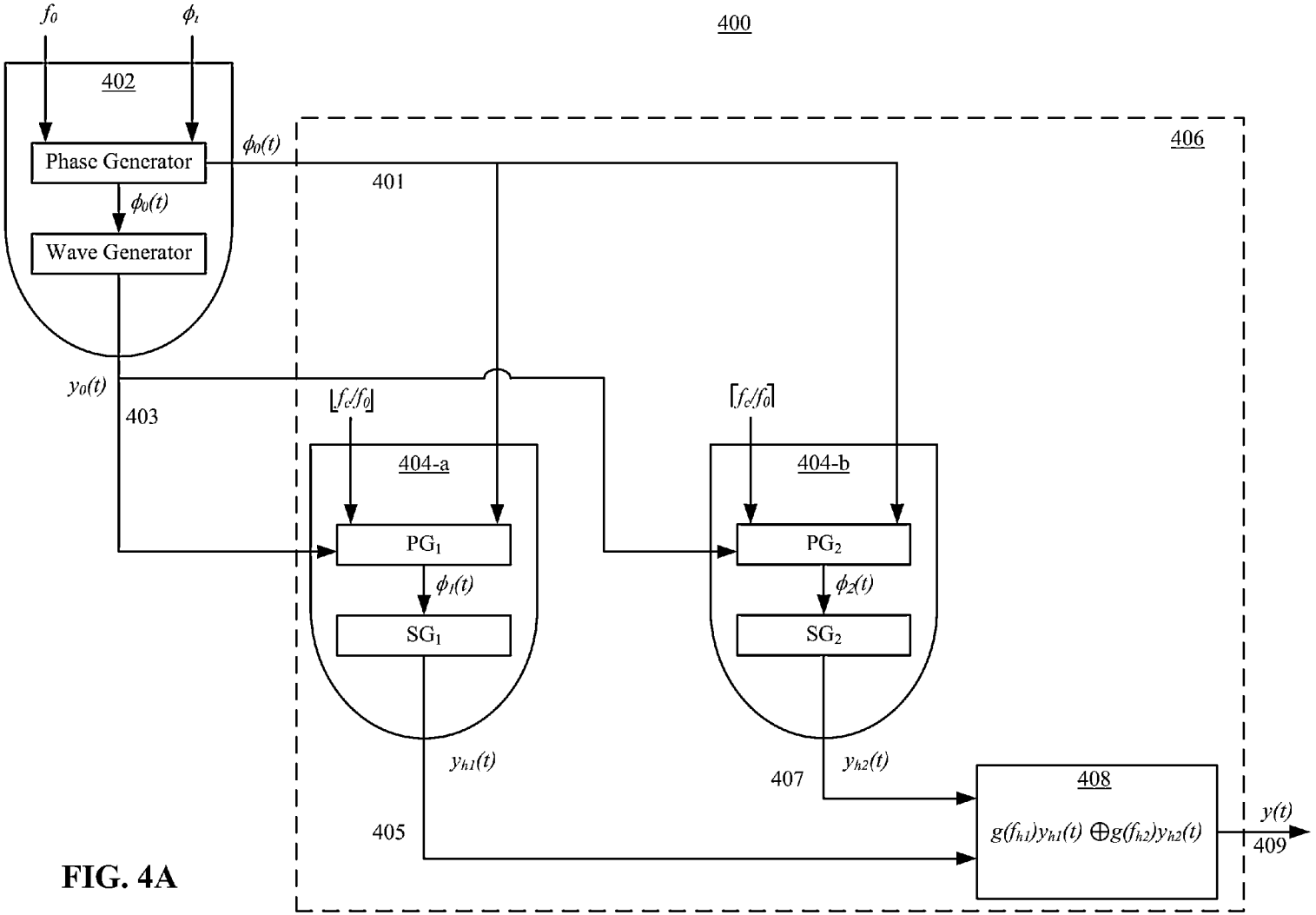
FIG. 4A illustrates a schematic diagram of a sound generator for generating a formant, in accordance with some implementations.

FIG. 4A illustrates a schematic flowchart of a sound generator 400 for generating a formant, in accordance with some implementations. A master generator 402 generates a master phase signal 401 and a master sound signal 403, based on a fundamental pitch frequency $f_0$ and an initial frequency $\phi_i$. In this example, the fundamental pitch frequency $f_0$ is also used as a modulation frequency. The master phase signal 401 is passed to oscillator 404-*a* and oscillator 404-*b*. Oscillators 404-*a* and 404-*b* together comprise a formant generator 406. In some implementations, more than two (e.g., 3, 4, 5, etc) oscillators are used to synthesize a single formant.

Oscillator 404-*a* generates a floor integer harmonic phase signal $\phi_1(t)$ using phase generator $PG_1$ based on the master phase signal, the fundamental pitch frequency $f_0$, and a formant center frequency $f_c$. Oscillator 404-*b* generates a ceiling integer harmonic phase signal $\phi_2(t)$ using phase generator $PG_2$ based on the master phase signal, the fundamental pitch frequency $f_0$, and the formant center frequency $f_c$. Each of the floor and ceiling integer harmonic phase signals are respectively modulated using the master sound signal 403. However, in some implementations, or in some circumstances (e.g., when the formant center frequency is equal to the frequency of one of the two oscillators), a modulation index for one of the oscillators 404 is equal to zero, effectively resulting in an un-modulated phase signal corresponding to the other oscillator of oscillators 404-*a* and 404-*b*. Oscillator 404-*a* generates a floor sound signal 405 using sound generator $SG_1$. Oscillator 404-*b* generates a ceiling sound signal 407 using sound generator $SG_2$. In some implementations, phase signal generation and sound signal generation is implemented using the pseudo-code 300 described with reference to FIG. 3. Sound signals 405 and 407 are passed to mixer 406 which mixes sound signal 405 and 407 in accordance with their respective gains, $g(f_{h1})$, to generate a formant sound signal 409. In some embodiments, when generating a time-varying formant, the harmonic numbers assigned to the two oscillators 404-*a* and 404-*b* are updated whenever the formant center frequency reaches or passes (from below to above, or from above to below) the frequency of either oscillator.

In some other embodiments, when generating a time-varying formant, the definitions of the two oscillators are swapped. As a result, when the formant center frequency reaches or passes the frequency of either oscillator (e.g., when a predefined integer approximation of a ratio of the formant frequency to the modulation frequency changes in value), the oscillator having a harmonic number corresponding to the floor function of the $f_c/f_0$ ratio is then assigned a harmonic number corresponding to the ceiling function of the $f_c/f_0$ ratio. Similarly, when the formant center frequency reaches or passes the frequency of either oscillator, the oscillator having a harmonic number corresponding to the ceiling function of the $f_c/f_0$ ratio is then assigned a harmonic number corresponding to the floor function of the $f_c/f_0$ ratio. As a result, the harmonic number and frequency of only one of the two oscillators is updated when the formant center frequency reaches or passes the frequency of either oscillator.

Figure 4B:
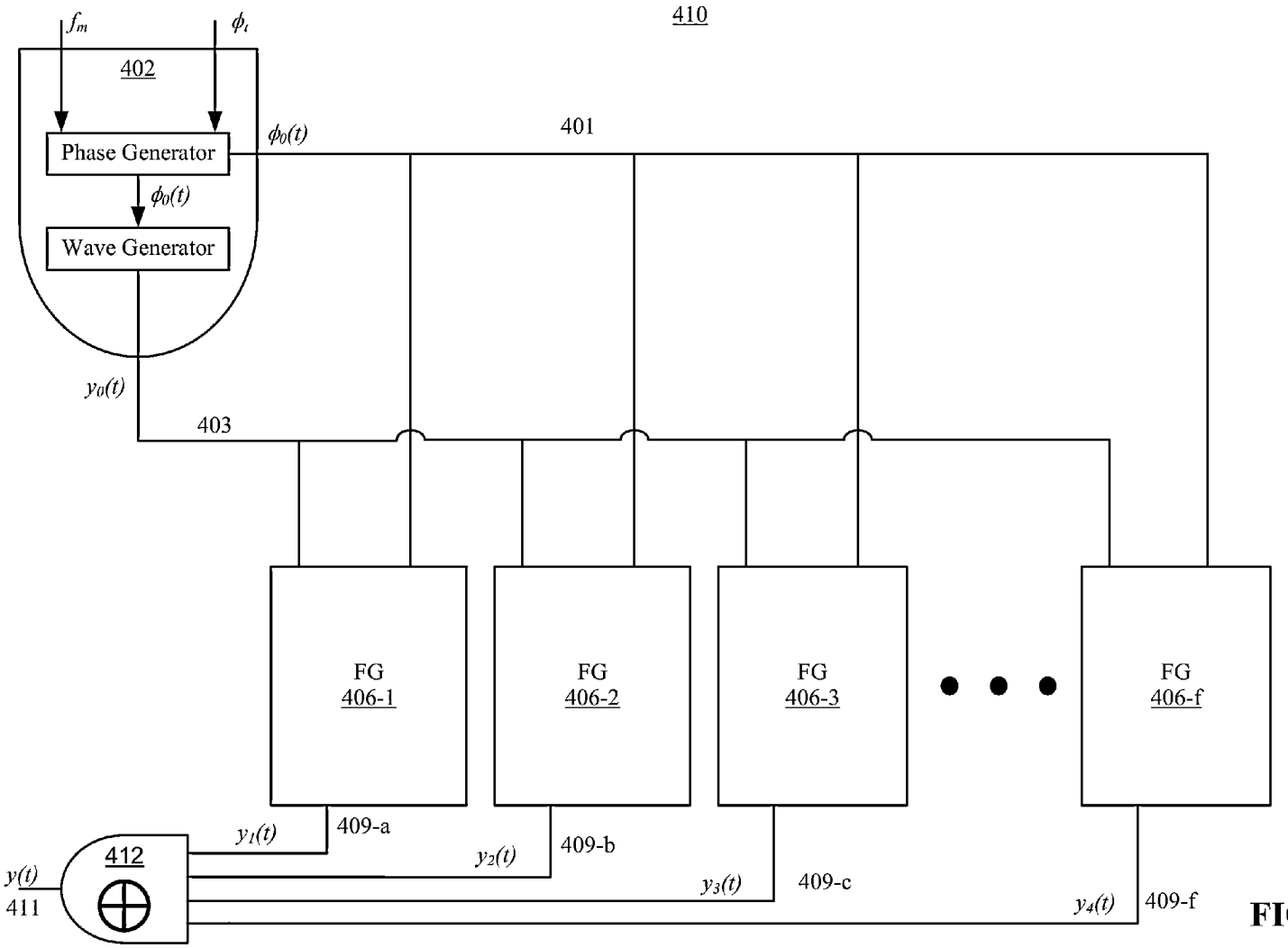
FIG. 4B illustrates a schematic diagram of a sound generator for generating a phoneme, in accordance with some implementations.

FIG. 4B illustrates a schematic flowchart of a sound generator 410 for generating a phoneme (e.g., a plurality of formants), in accordance with some implementations. The master phase signal 401 is passed to formant generators 406-*a* through 406-*f* (each of which is analogous to formant generator 406, FIG. 4A). The master sound signal 403 is also passed to formant generators 406-*a* through 406-*f* to modulate the individual oscillators in each formant generator, each oscillator modulated according to an individual oscillator modulation index. Each formant generator 406 generates a formant sound signal 409. Finally, the formant sound signals 409 are passed to mixer 412 and combined by mixer 412 to produce a phoneme sound signal 411.

Figure 5:
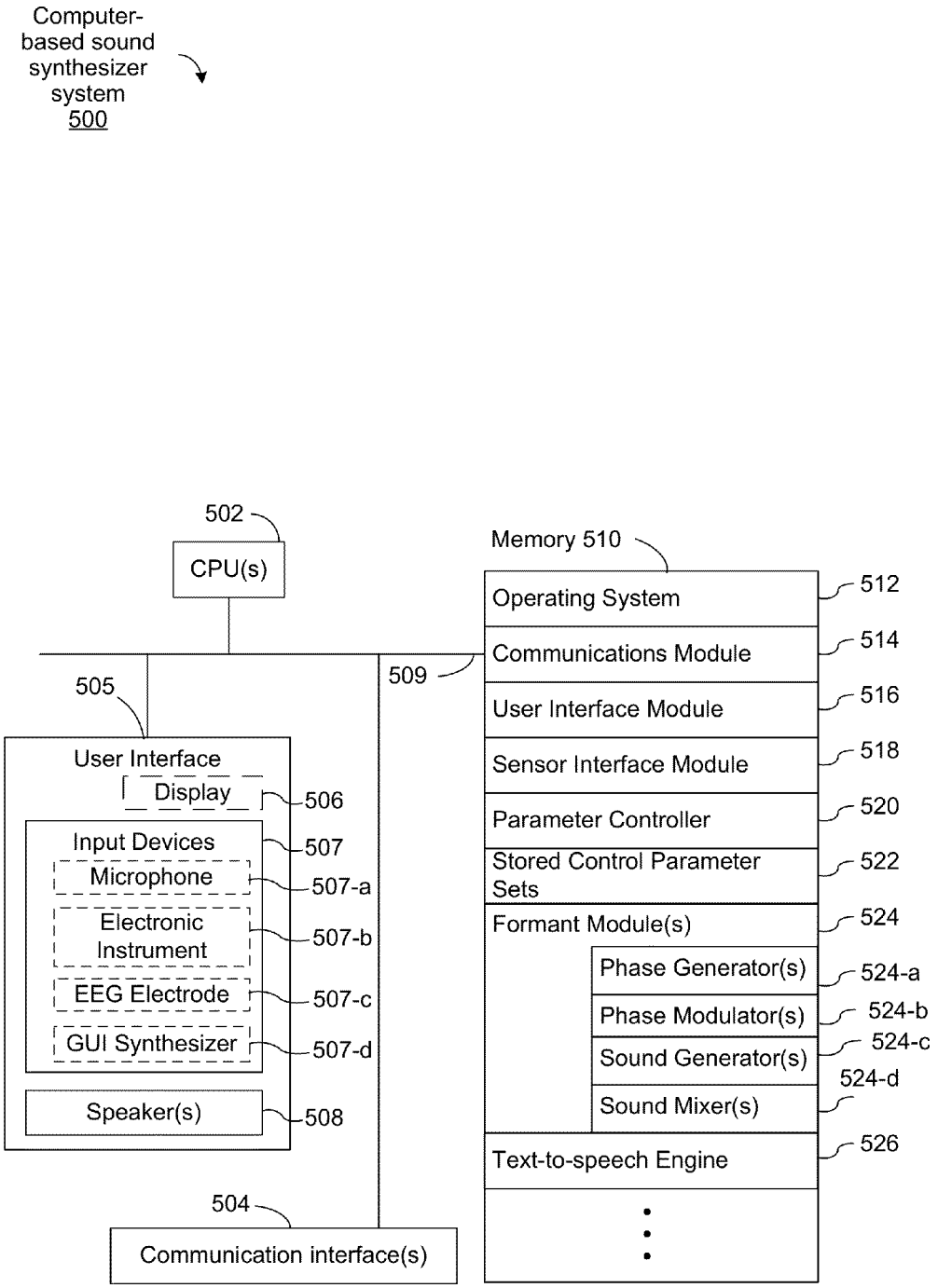
FIG. 5 is a diagram of an exemplary computer-implemented sound synthesizer, in accordance with some implementations.

FIG. 5 is a diagram of an exemplary computer-implemented sound synthesizer 500, in accordance with some implementations. While certain specific features are illustrated, those skilled in the art will appreciate from the present disclosure that various other features have not been illustrated for the sake of brevity and so as not to obscure more pertinent aspects of the implementations disclosed herein. To that end, sound synthesizer 500 includes one or more processing units (CPU's) 502, one or more network or other communications interfaces 504, one or more user interface devices 505, and memory 510. Communication between various components of sound synthesizer 500 is achieved over one or more communications buses 509. The communication buses 509 may include circuitry (sometimes called a chipset) that interconnects and controls communications between system components.

In some implementations, user interface devices 505 include a display 506. The display 506 may function together with other user interface devices 505 such as graphical user interface synthesizer 507-*d*.

In some implementations, the one or more user interface device 505 includes one or more input devices 507, such as a microphone 507-*a* for recording and re-synthesizing sound, an electronic instrument 507-*b* (such as an electric keyboard, an electric violin, and the like), one or more electroencephalography (EEG) electrodes 507-*c* for auditory display of rapid fluctuations in brain signals, and/or a graphical user interface synthesizer (GUI) 507-*d*, which displays (e.g., on display 506) a plurality of controls through which a user may interact to produce sound.

Memory 510 includes high-speed random access memory, such as DRAM, SRAM, DDR RAM or other random access solid state memory devices; and optionally includes non-volatile memory, such as one or more magnetic disk storage devices, optical disk storage devices, flash memory devices, or other non-volatile solid state storage devices. Memory 510 optionally includes one or more storage devices remotely located from the CPU(s) 502. Memory 510, including the non-volatile and volatile memory device(s) within the memory 510, comprises a non-transitory computer readable storage medium.

In some implementations, memory 510 or the non-transitory computer readable storage medium of memory 510 stores the following programs, modules and data structures, or a subset thereof including an operating system 512, a network communication module 514.

In some implementations, memory 510 optionally includes a user interface module 516 for interfacing with, for example, GUI synthesizer 507-*d*.

In some implementations, memory 510 also optionally includes a sensor interface module 518 for interfacing with sensors such as EEG electrodes 507-*c*.

In some implementations, memory 510 optionally includes a parameter controller 520 that controls (e.g., executes instructions for) the generation of a set of acoustic parameters, including a plurality of time-varying acoustic parameters such as a formant center frequency parameter (sometimes called a vibrato parameter, a vowel-control parameter, an intensity-control parameter, a pitch-control parameter, and/or an identity-control parameter). Parameter controller 520 also interacts with input devices 507 to facilitate selection of parameters (e.g., any of the aforementioned parameters) and corresponding parameter values based on the sensor(s) selected and sensor signals obtained. For example, sensor interface module 518 may interface with parameter controller 520 to communicate a set of parameters, corresponding to one or more of pitch, vowel selection, vibrato, and intensity (amplitude), selected in accordance with any one of the selected sensors, (e.g., one or more EEG electrodes 507-*c*), electronic instrument 507-*b*, GUI synthesizer 507-*d*, etc.

In some implementations, memory 510 optionally includes stored control parameter sets 522 that include one or more sets of signal parameters or values corresponding to signal parameters (for example, one or more values of base frequencies, a set of acoustic waveform patterns corresponding to phoneme patterns, one or more sonic identities etc.). Stored control parameter sets 522 may also include one or more libraries of phonemes (e.g., data structures corresponding to phonemes storing formant frequencies and strengths).

In some implementations, memory 510 includes one or more formant module(s) 524. In some implementations, formant module(s) 524 are software implementations of formant generators 406, as described with reference to FIG. 4A-4B. Each formant module 524 includes two or more phase generators 524-*a*, two or more phase modulators 524-*b*, one or more sound generator(s) 524-*c*, and one or more sound mixer(s) 524-*d* (e.g., software implementations of sound mixers 408/412). In some implementations, various components of formant module(s) 524 are implemented as described with reference to pseudo-code 300 (FIG. 3).

In some implementations, memory 510 includes a text-to-speech engine 526. Text-to-speech engine 526 converts a text string to a series of phonemes (e.g., using a phoneme library in stored control parameter sets 522), each of which comprises a plurality of formants, each formant having a time-varying center frequency and strength stored in the library. The formant's time-varying center frequencies and strengths are passed to formant modules 524 for sound production.

Figure 6A:
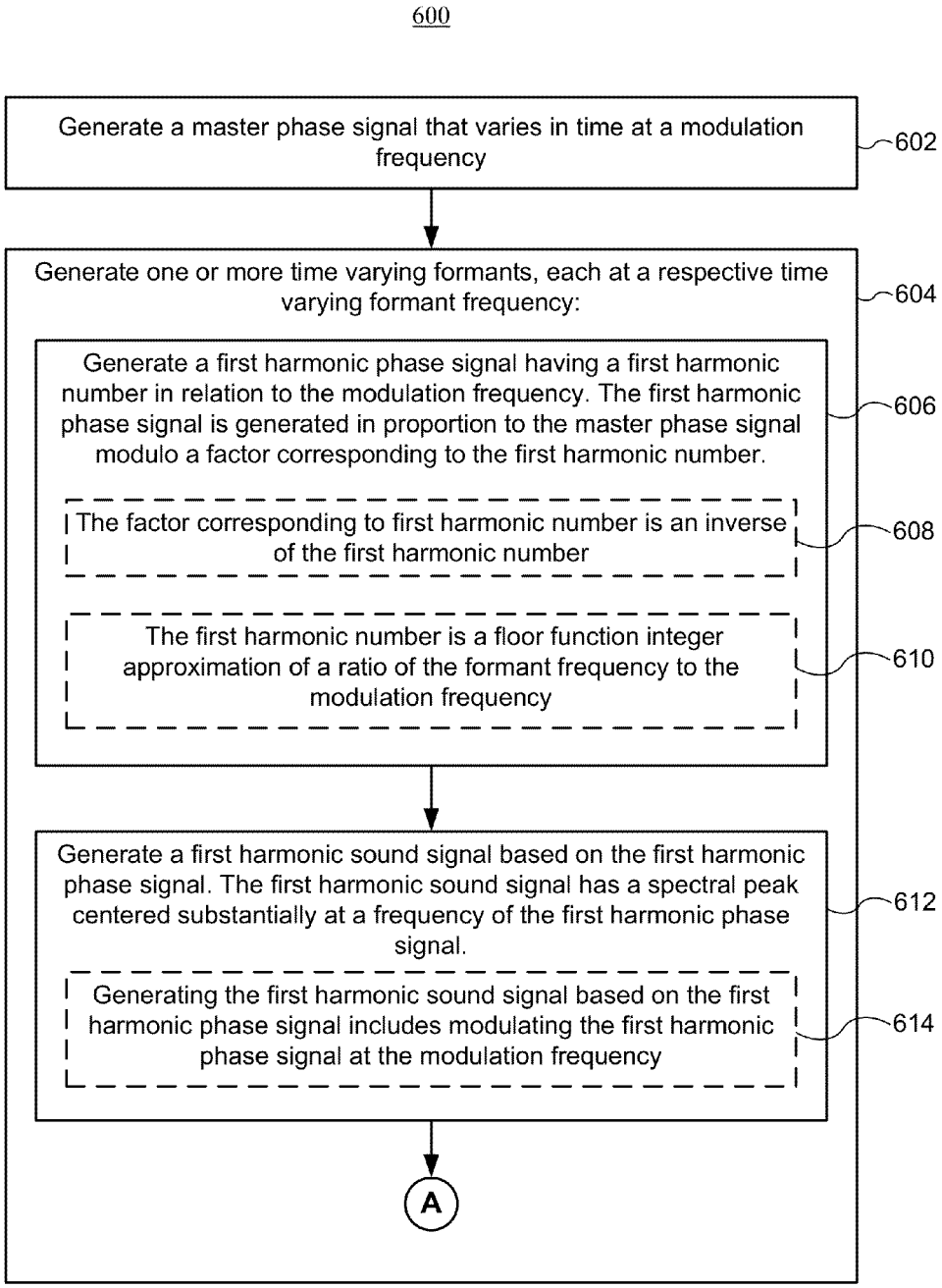
FIGS. 6A-6C are flowcharts illustrating a glitch-free FM synthesis method of synthesizing sound.
Figure 6B:
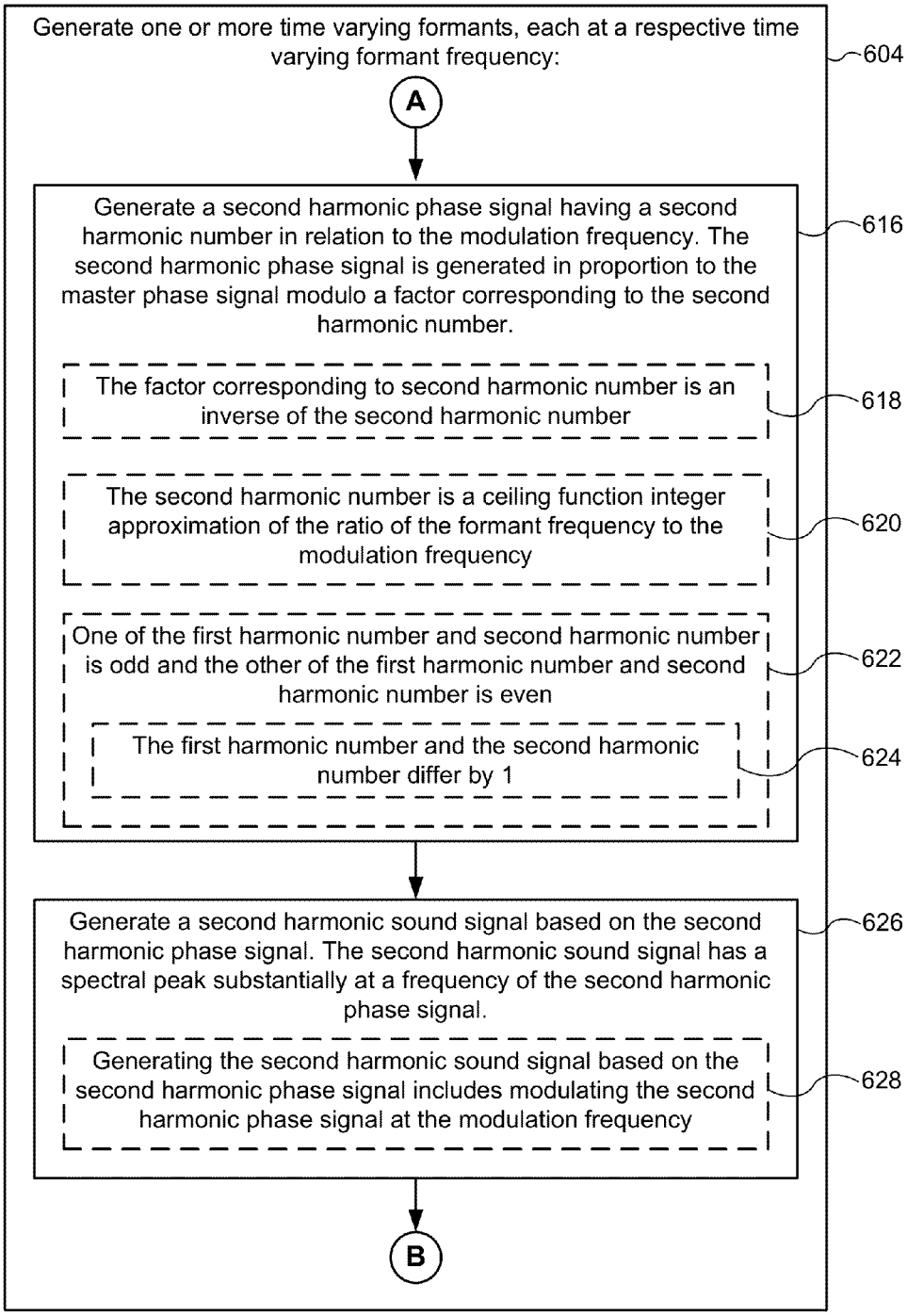
Figure 6C:
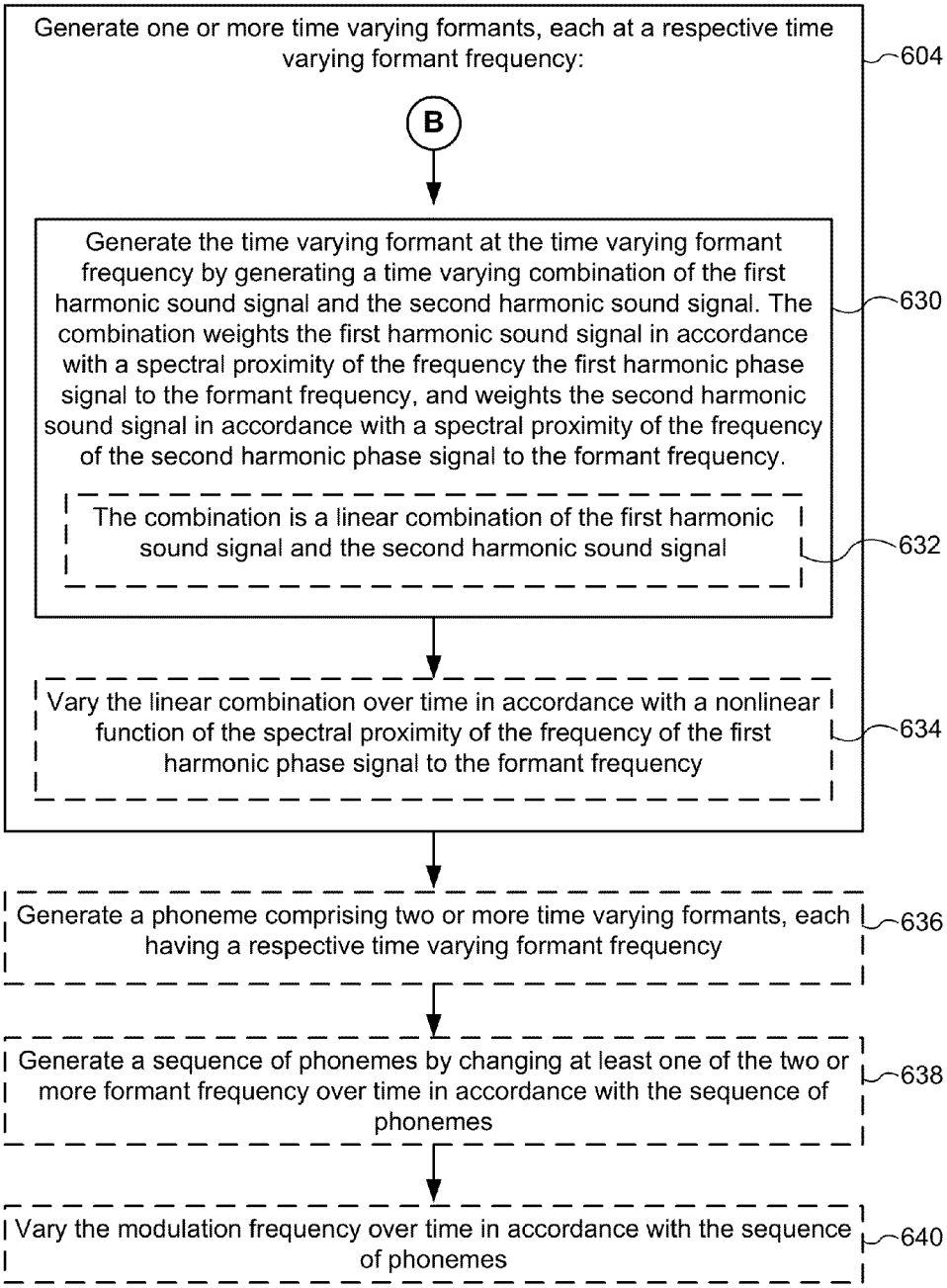

FIGS. 6A-6C are flowcharts illustrating a method 600 of synthesizing sound. In some circumstances, without limitation, the synthesized sound is a sequence of phonemes such as a vowel alteration (e.g., "ee-oo-ee-oo"), a vibrato, a melody, a sequence of morphemes and/or words, or a change in timbre of a single phoneme. Other synthesized sounds will be apparent to one skilled in the art.

The method 600 includes generating (602) a master phase signal $\phi_0(t)$ that varies in time at a modulation frequency $f_m(t)$. In some implementations, the modulation frequency $f_m(t)$ is the perceived pitch $f_0$ of the synthesized sound. The method further includes generating (604) one or more time-varying formants, each at a respective time-varying formant frequency $f_c(t)$ (e.g., a formant center frequency). In some implementations, each of the one or more time-varying formants is generated as described with reference to operations 606 through 634.

The method 600 further includes generating (606) a first harmonic phase signal $\phi_1(t)$ having a first harmonic number kin relation to the modulation frequency. The first harmonic phase signal is generated in proportion to the master phase signal $\phi_0(t)$ modulo a factor corresponding to the first harmonic number. In some implementations, the factor corresponding to the first harmonic number is (608) an inverse of the first harmonic number. For example, the first harmonic phase signal is generated using the equation:

$$\phi_1 = h_1 \times \phi_0 \mathrm{mod}\left(\frac{1}{h_1}\right)$$

In some implementations, the first harmonic number is (610) a floor function integer approximation of a ratio of the formant center frequency to the modulation frequency. For example, the first harmonic number is calculated according the equation:

$$h_1 = \lfloor f_c(t)/f_m(t) \rfloor$$

where $f_c(t)$ is the formant center frequency at time t, and $f_m(t)$ is the modulation frequency at time t. The method 600 further includes generating (612) a first harmonic sound signal $y_{h1}(t)$ based on the first harmonic phase signal. The first harmonic sound signal has a spectral peak centered substantially at a frequency of the first harmonic phase signal. In some implementations, generating (614) the first harmonic sound signal based on the first harmonic phase signal includes modulating the first harmonic phase signal at the modulation frequency.

In some implementations, the first harmonic phase signal is modulated according to the equation:

$$\phi_1 = h_1\left(\phi_0 \mathrm{mod}\left(\frac{1}{h_1}\right) + m_1\right),$$

where $m_1 = i_1 \sin(2\pi\phi_0)$ and $i_1$ is a modulation index for the first harmonic phase signal.

The method 600 further includes generating (616) a second harmonic phase signal having a second harmonic number in relation to the modulation frequency. The second harmonic phase signal is generated in proportion to the master phase signal modulo a factor corresponding to the second harmonic number. In some implementations, the factor corresponding to second harmonic number is (618) an inverse of the second harmonic number. For example, the second harmonic phase signal is generated using the equation:

$$\phi_2 = h_2 \times \phi_0 \mathrm{mod}\left(\frac{1}{h_2}\right)$$

In some implementations, the second harmonic number is (620) a ceiling function integer approximation of the ratio of the formant center frequency to the modulation frequency. For example, the first harmonic number is calculated according the equation:

$$h_2 = \lceil f_c(t)/f_0(t) \rceil$$

In some implementations, one of the first harmonic number and second harmonic number is (622) odd and the other of the first harmonic number and second harmonic number is even. In some implementations, the first harmonic number and the second harmonic number differ (624) by 1.

In some implementations, the first and second harmonic phase signals are generated using hardware, software, or a combination thereof. For example, the first harmonic phase signal may be generated using a phase generator module 524-*a* (FIG. 5), which, in some implementations, is a software implementation of phase generator $PG_1$ in formant generator 404-*a* (FIG. 4).

The method 600 further includes generating (626) a second harmonic sound signal $y_{h2}(t)$ based on the second harmonic phase signal. The second harmonic sound signal has a spectral peak substantially at a frequency of the second harmonic phase signal. In some implementations, generating (628) the second harmonic sound signal based on the second harmonic phase signal includes modulating the second harmonic phase signal at the modulation frequency.

In some implementations, the second harmonic phase signal is modulated according to the equation:

$$\phi_2 = h_2\left(\phi_0 \mathrm{mod}\left(\frac{1}{h_2}\right) + m_2\right),$$

where $m_2 = i_2 \sin(2\pi\phi_0)$ and $i_2$ is a modulation index for the first harmonic phase signal.

The method further includes generating (630) the time-varying formant y(t) at the time-varying formant frequency by generating a time-varying combination of the first harmonic sound signal and the second harmonic sound signal. The combination weights the first harmonic sound signal in accordance with a spectral proximity of the frequency the first harmonic phase signal to the formant frequency, and weights the second harmonic sound signal in accordance with a spectral proximity of the frequency of the second harmonic phase signal to the formant frequency. In some implementations, the combination is a linear combination of the first harmonic sound signal and the second harmonic sound signal.

In some implementations, the method 600 further includes varying (634) the linear combination over time in accordance with a nonlinear function (e.g., a nonlinear cross fade ramp) of the spectral proximity of the frequency of the first harmonic phase signal to the formant frequency. In some implementations, the nonlinear function is a power law function of the spectral proximity of the frequency of the first harmonic phase signal to the formant frequency.

In some implementations, the method 600 further includes generating (636) a phoneme comprising two or more time-varying formants, each having a respective time-varying formant frequency. For example, to generate a time-varying formant, in accordance with the time-varying formant frequency of that formant, one or more of the first harmonic number and the second harmonic number (used to generate the first harmonic sound signal and the second harmonic sound signal, respectively, of the formant) is updated in accordance with a change in a predefined integer approximation (e.g., the aforementioned floor function integer approximation and/or ceiling function integer approximation) of the ratio of the formant frequency to the modulation frequency. Furthermore, in this example, in accordance with the one or more of the first harmonic number and the second harmonic number, which are being updated, the method 600 includes continuing to generate the first harmonic sound signal and the second harmonic sound signal, and continuing to generate the time-varying formant at the time-varying formant frequency by generating a time-varying combination of the first harmonic sound signal and the second harmonic sound signal.

As the formant frequency continues to change over time, each change in a predefined integer approximation of the ratio of the formant frequency to the modulation frequency causes a new update to at least one of the first harmonic number and second harmonic number, and the generation of the first harmonic sound signal and the second harmonic sound signal continues in accordance with the updates to the first and second harmonic numbers. As explained above, in some embodiments the time-varying combination of the first harmonic sound signal and the second harmonic sound signal weights the first harmonic sound signal in accordance with a spectral proximity of the frequency the first harmonic phase signal to the formant frequency, and weights the second harmonic sound signal in accordance with a spectral proximity of the frequency of the second harmonic phase signal to the formant frequency.

In some implementations, the method 600 further includes generating (638) a sequence of phonemes by changing at least one of the two or more formant frequencies over time in accordance with the sequence of phonemes.

In some implementations, the method 600 further includes varying (640) the modulation frequency over time in accordance with the sequence of phonemes.

Figure 7A:
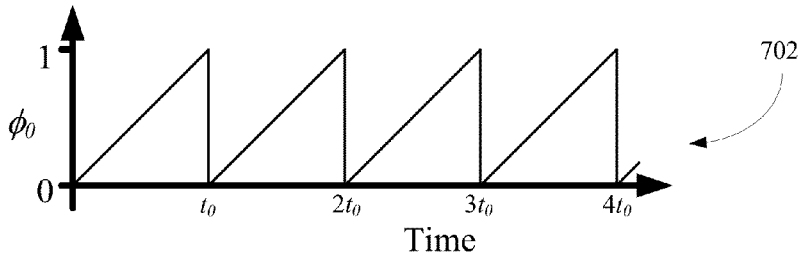
FIGS. 7A-7C illustrate exemplary phase signals generated in accordance with some implementations.
Figure 7B:
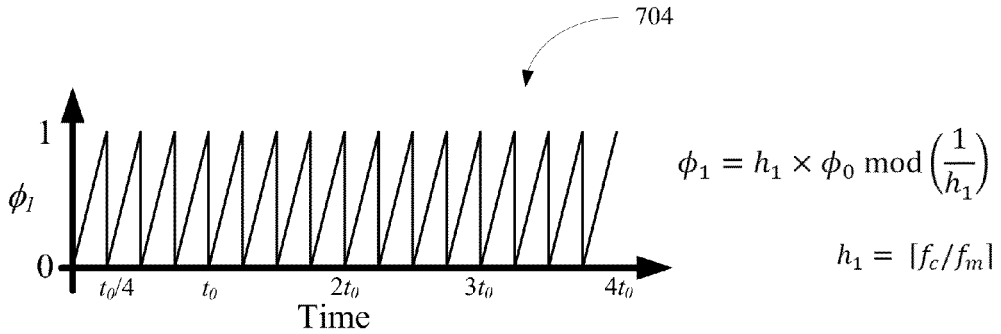
Figure 7C:
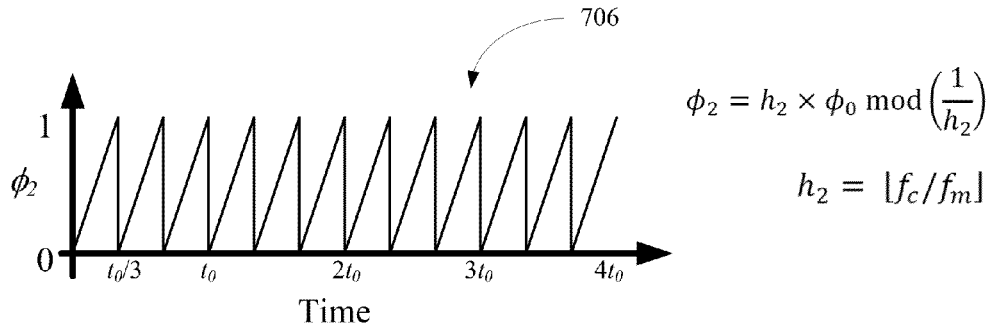

FIGS. 7A-7C illustrate exemplary phase signals generated in accordance with method 600. For simplicity, the phase signals are shown each with a modulation index equal to zero (i.e., the phase signals are not modulated). FIG. 7A illustrates an exemplary master phase signal 702 having a period equal to $t_0$ and a frequency equal to $f_0=1/t_0$. FIG. 7B illustrates a phase signal 704 (e.g., a first harmonic phase signal) for a 4th harmonic of the master signal (e.g., a ceiling harmonic integer approximation to a formant with a formant carrier frequency between $3f_0$ and $4f_0$). FIG. 7C illustrates a phase signal 706 (e.g., a second harmonic phase signal) for a 3rd harmonic of the master signal (e.g., a floor harmonic integer approximation to the formant with a formant center frequency between $3f_0$ and $4f_0$). Phase signals 704 and 706 are phase-synchronized with respect to one another in that they are each derived from master phase signal 702, and, more specifically, have a constant phase relationship to one another at any time that is integer multiple of the master phase period $t_0$.

Figure 8:
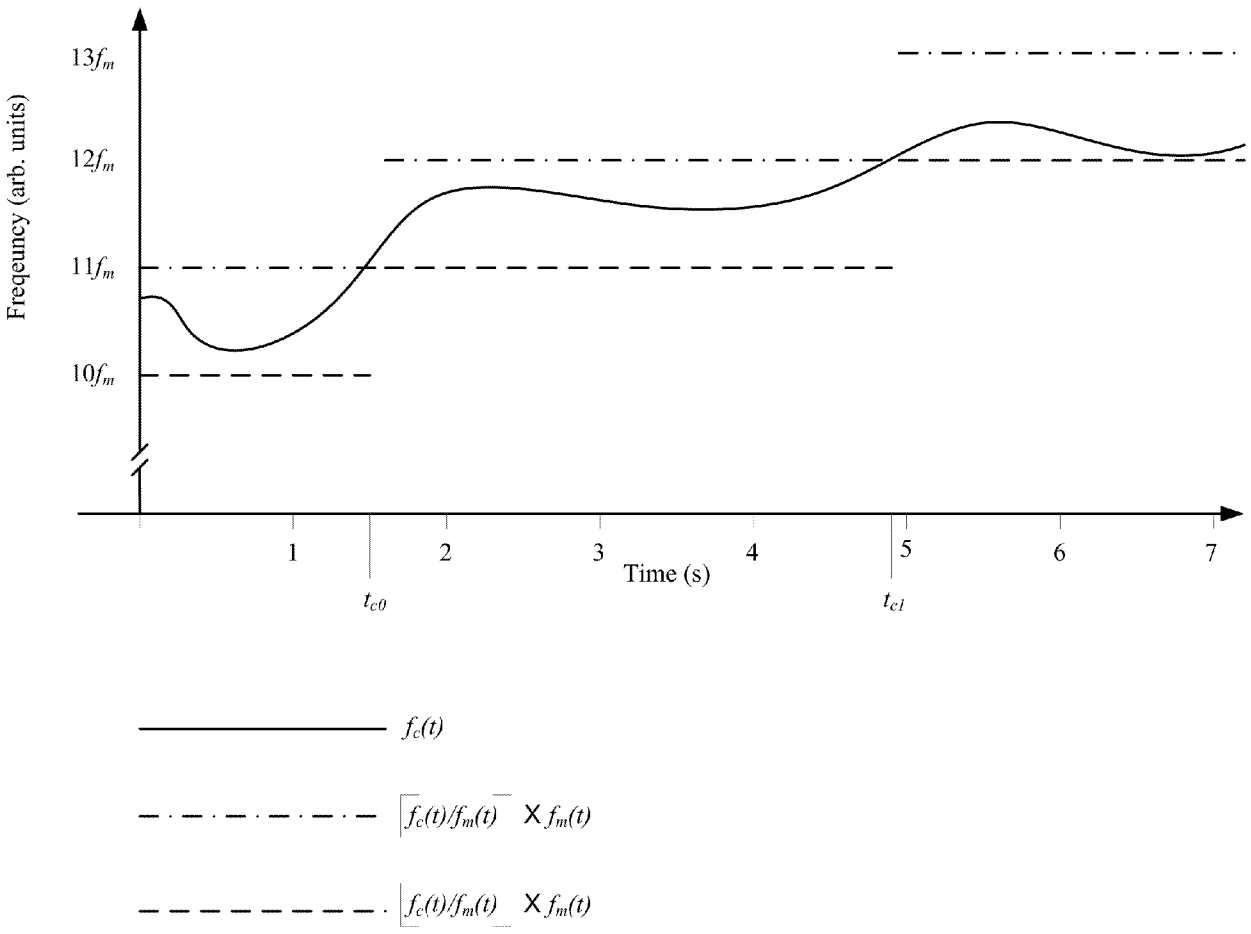
FIG. 8 illustrates an example of a synthesized time-varying formant frequency.

FIG. 8 illustrates an example of a harmonic assignments when synthesizing a time-varying formant frequency $f_c(t)$. For simplicity, FIG. 8 illustrates an example in which the pitch, or modulation frequency, remains constant. It should be appreciated, however, that both the formant frequency and the pitch frequency may change with time. Between t=0 and $t_{c0}$, the formant is approximated by oscillators having a frequency of $11f_m$ and $10f_m$, respectively (that is, their harmonic number assignments are 11 and 10, respectively). At time $t_{c0}$, an excursion in the formant frequency requires the oscillator's harmonic number assignments to be changed to $11f_m$ and $12f_m$, respectively. In some implementations, each oscillator is increment by one harmonic number (e.g., $h_1$: 10→11 and $h_2$: 11→12). In some implementations, one harmonic number is incremented by 2 and the other remains fixed (e.g., $h_1$: 11→11 and $h_2$: 10→12). Likewise, at time $t_{c1}$, an excursion in the formant frequency requires an update to the harmonic numbers again.

The foregoing description, for purpose of explanation, has been described with reference to specific implementations. However, the illustrative discussions above are not intended to be exhaustive or to limit the implementations to the precise forms disclosed. Many modifications and variations are possible in view of the above teachings. The implementations were chosen and described in order to best explain the principles of the disclosure and its practical applications, to thereby enable others skilled in the art to best utilize the various implementations with various modifications as are suited to the particular use contemplated.

What is claimed is:

1. A method of synthesizing sound, comprising:

at a computer-based sound synthesizer system including one or more processors and memory storing programs for execution by the processors:

generating a master phase signal, wherein the master phase signal varies in time at a modulation frequency; and generating one or more time-varying formants, each at a respective time-varying formant frequency, wherein generating each time-varying formant comprises:

generating a first harmonic phase signal having a first harmonic number in relation to the modulation frequency, wherein the first harmonic phase signal is generated in proportion to the master phase signal modulo a factor corresponding to the first harmonic number;

generating a first harmonic sound signal based on the first harmonic phase signal, wherein the first harmonic sound signal has a spectral peak centered substantially at a frequency of the first harmonic phase signal;

generating a second harmonic phase signal having a second harmonic number in relation to the modulation frequency, wherein the second harmonic phase signal is generated in proportion to the master phase signal modulo a factor corresponding to the second harmonic number;

generating a second harmonic sound signal based on the second harmonic phase signal, wherein the second harmonic sound signal has a spectral peak substantially at a frequency of the second harmonic phase signal; and generating the time-varying formant at the time-varying formant frequency by generating a time-varying combination of the first harmonic sound signal and the second harmonic sound signal, wherein the combination weights the first harmonic sound signal in accordance with a spectral proximity of the frequency the first harmonic phase signal to the formant frequency, and weights the second harmonic sound signal in accordance with a spectral proximity of the frequency of the second harmonic phase signal to the formant frequency.

2. The method of claim 1, wherein the factor corresponding to first harmonic number is an inverse of the first harmonic number, and the factor corresponding to second harmonic number is an inverse of the second harmonic number.

3. The method of claim 1, wherein:

generating the first harmonic sound signal based on the first harmonic phase signal includes modulating the first harmonic phase signal at the modulation frequency; and generating the second harmonic sound signal based on the second harmonic phase signal includes modulating the second harmonic phase signal at the modulation frequency.

4. The method of claim 1, wherein:

the first harmonic number is a floor function integer approximation of a ratio of the formant frequency to the modulation frequency; and the second harmonic number is a ceiling function integer approximation of the ratio of the formant frequency to the modulation frequency.

5. The method of claim 1, further comprising generating a phoneme comprising two or more of said time-varying formants, each having a respective time-varying formant frequency.

6. The method of claim 1, further comprising generating a sequence of phonemes by changing at least one of the respective time-varying formant frequencies over time in accordance with the sequence of phonemes.

7. The method of claim 1, wherein one of the first harmonic number and second harmonic number is odd and the other of the first harmonic number and second harmonic number is even.

8. The method of claim 7, wherein the first harmonic number and the second harmonic number differ by 1.

9. The method of claim 1, wherein the combination is a linear combination of the first harmonic sound signal and the second harmonic sound signal.

10. The method of claim 9, further comprising varying the linear combination over time in accordance with a nonlinear function of the spectral proximity of the frequency of the first harmonic phase signal to the formant frequency.

11. The method of claim 1, further comprising:

in accordance with the time-varying formant frequency, updating one or more of the first harmonic number and the second harmonic number in accordance with a change in predefined integer approximation of a ratio of the formant frequency to the modulation frequency; and in accordance with the updated one or more of the first harmonic number and the second harmonic number, continuing to generate the first harmonic sound signal and the second harmonic sound signal, and continuing to generate the time-varying formant at the time-varying formant frequency by continuing to generate the time-varying combination of the first harmonic sound signal and the second harmonic sound signal.

12. A non-transitory computer readable storage medium storing one or more programs configured for execution by one or more processors of a computer-based sound synthesizer system, the one or more programs comprising instructions to:

generate a master phase signal, wherein the master phase signal varies in time at a modulation frequency; and generate one or more time-varying formants, each at a respective time-varying formant frequency, wherein generating each time-varying formant comprises:

generating a first harmonic phase signal having a first harmonic number in relation to the modulation frequency, wherein the first harmonic phase signal is generated in proportion to the master phase signal modulo a factor corresponding to the first harmonic number;

generating a first harmonic sound signal based on the first harmonic phase signal, wherein the first harmonic sound signal has a spectral peak centered substantially at a frequency of the first harmonic phase signal;

generating a second harmonic phase signal having a second harmonic number in relation to the modulation frequency, wherein the second harmonic phase signal is generated in proportion to the master phase signal modulo a factor corresponding to the second harmonic number;

generating a second harmonic sound signal based on the second harmonic phase signal, wherein the second harmonic sound signal has a spectral peak substantially at a frequency of the second harmonic phase signal; and generating the time-varying formant at the time-varying formant frequency by generating a time-varying combination of the first harmonic sound signal and the second harmonic sound signal, wherein the combination weights the first harmonic sound signal in accordance with a spectral proximity of the frequency the first harmonic phase signal to the formant frequency, and weights the second harmonic sound signal in accordance with a spectral proximity of the frequency of the second harmonic phase signal to the formant frequency.

13. The computer readable storage medium of claim 12, wherein the factor corresponding to first harmonic number is an inverse of the first harmonic number, and the factor corresponding to second harmonic number is an inverse of the second harmonic number.

14. The computer readable storage medium of claim 12, wherein:

generating the first harmonic sound signal based on the first harmonic phase signal includes modulating the first harmonic phase signal at the modulation frequency; and generating the second harmonic sound signal based on the second harmonic phase signal includes modulating the second harmonic phase signal at the modulation frequency.

15. The computer readable storage medium of claim 12, wherein:

the first harmonic number is a floor function integer approximation of a ratio of the formant frequency to the modulation frequency; and the second harmonic number is a ceiling function integer approximation of the ratio of the formant frequency to the modulation frequency.

16. The computer readable storage medium of claim 12, wherein the one or more programs further include instructions that, when executed by the by one or more processors, cause the synthesizer system to generate a phoneme comprising two or more of said time-varying formants, each having a respective time-varying formant frequency.

17. The computer readable storage medium of claim 16, wherein the one or more programs further include instructions that, when executed by the by one or more processors, cause the synthesizer system to generate a sequence of phonemes by changing at least one of the respective time-varying formant frequencies over time in accordance with the sequence of phonemes.

18. The computer readable storage medium of claim 17, wherein the one or more programs further include instructions that, when executed by the by one or more processors, cause the synthesizer system to vary the modulation frequency over time in accordance with the sequence of phonemes.

19. The computer readable storage medium of claim 18, wherein the first harmonic number and the second harmonic number differ by 1.

20. The computer readable storage medium of claim 12, wherein the combination is a linear combination of the first harmonic sound signal and the second harmonic sound signal.

21. The computer readable storage medium of claim 20, wherein the one or more programs further include instructions that, when executed by the by one or more processors, cause the synthesizer system to vary the linear combination over time in accordance with a nonlinear function of the spectral proximity of the frequency of the first harmonic phase signal to the formant frequency.

22. The computer readable storage medium of claim 12, wherein the one or more programs further include instructions that, when executed by the by one or more processors, cause the synthesizer system to:

update, in accordance with the time-varying formant frequency, one or more of the first harmonic number and the second harmonic number in accordance with a change in a predefined integer approximation of a ratio of the formant frequency to the modulation frequency; and in accordance with the updated one or more of the first harmonic number and the second harmonic number, continue to generate the first harmonic sound signal and the second harmonic sound signal, and continue to generate the time-varying formant at the time-varying formant frequency by continuing to generate the time-varying combination of the first harmonic sound signal and the second harmonic sound signal.

23. A computer-based sound synthesizer system comprising:

one or more processors;

memory storing one or more programs that, when executed by the one or more processors, cause the synthesizer system to:

generate a master phase signal, wherein the master phase signal varies in time at a modulation frequency; and generate one or more time-varying formants, each at a respective time-varying formant frequency, wherein generating each time-varying formant comprises:

generating a first harmonic phase signal having a first harmonic number in relation to the modulation frequency, wherein the first harmonic phase signal is generated in proportion to the master phase signal modulo a factor corresponding to the first harmonic number;

generating a first harmonic sound signal based on the first harmonic phase signal, wherein the first harmonic sound signal has a spectral peak centered substantially at a frequency of the first harmonic phase signal;

generating a second harmonic phase signal having a second harmonic number in relation to the modulation frequency, wherein the second harmonic phase signal is generated in proportion to the master phase signal modulo a factor corresponding to the second harmonic number;

generating a second harmonic sound signal based on the second harmonic phase signal, wherein the second harmonic sound signal has a spectral peak substantially at a frequency of the second harmonic phase signal; and generating the time-varying formant at the time-varying formant frequency by generating a time-varying combination of the first harmonic sound signal and the second harmonic sound signal, wherein the combination weights the first harmonic sound signal in accordance with a spectral proximity of the frequency the first harmonic phase signal to the formant frequency, and weights the second harmonic sound signal in accordance with a spectral proximity of the frequency of the second harmonic phase signal to the formant frequency.

24. The sound synthesizer system of claim 23, wherein the factor corresponding to first harmonic number is an inverse of the first harmonic number, and the factor corresponding to second harmonic number is an inverse of the second harmonic number.

25. The sound synthesizer system of claim 23, wherein:

generating the first harmonic sound signal based on the first harmonic phase signal includes modulating the first harmonic phase signal at the modulation frequency; and generating the second harmonic sound signal based on the second harmonic phase signal includes modulating the second harmonic phase signal at the modulation frequency.

26. The sound synthesizer system of claim 23, wherein one of the first harmonic number and second harmonic number is odd and the other of the first harmonic number and second harmonic number is even.

27. The sound synthesizer system of claim 26, wherein the first harmonic number and the second harmonic number differ by 1.

28. An apparatus, comprising:

a master phase generator that generates a master phase signal, wherein the master phase signal varies in time at a modulation frequency; and a formant generator that generates one or more time-varying formants, each at a respective time-varying formant frequency, wherein generating each time-varying formant comprises:

generating a first harmonic phase signal having a first harmonic number in relation to the modulation frequency, wherein the first harmonic phase signal is generated in proportion to the master phase signal modulo a factor corresponding to the first harmonic number;

generating a first harmonic sound signal based on the first harmonic phase signal, wherein the first harmonic sound signal has a spectral peak centered substantially at a frequency of the first harmonic phase signal;

generating a second harmonic phase signal having a second harmonic number in relation to the modulation frequency, wherein the second harmonic phase signal is generated in proportion to the master phase signal modulo a factor corresponding to the second harmonic number;

generating a second harmonic sound signal based on the second harmonic phase signal, wherein the second harmonic sound signal has a spectral peak substantially at a frequency of the second harmonic phase signal; and generating the time-varying formant at the time-varying formant frequency by generating a time-varying combination of the first harmonic sound signal and the second harmonic sound signal, wherein the combination weights the first harmonic sound signal in accordance with a spectral proximity of the frequency the first harmonic phase signal to the formant frequency, and weights the second harmonic sound signal in accordance with a spectral proximity of the frequency of the second harmonic phase signal to the formant frequency.

* * * * *